US011280071B1

(12) United States Patent
Knight

(10) Patent No.: US 11,280,071 B1
(45) Date of Patent: Mar. 22, 2022

(54) SPOUTED BASE FAUCET

(71) Applicant: Hayes-Ivy Manufacturing, Inc., New Tripoli, PA (US)

(72) Inventor: Peter H Knight, Ft. Lauderdale, FL (US)

(73) Assignee: Hayes-Ivy Manufacturing, Inc., New Tripoli, PA (US)

( * ) Notice: Subject to any disclaimer, the term of this patent is extended or adjusted under 35 U.S.C. 154(b) by 0 days.

(21) Appl. No.: 17/369,651

(22) Filed: Jul. 7, 2021

(51) Int. Cl.
*E03C 1/04* (2006.01)

(52) U.S. Cl.
CPC ..... *E03C 1/0404* (2013.01)

(58) Field of Classification Search
CPC ..... E03C 1/0404; E03C 1/0403; E03C 1/04; E03C 2001/0414–0417; E03C 1/021; E03C 1/023; E03C 1/025
See application file for complete search history.

(56) References Cited

U.S. PATENT DOCUMENTS 1,741,521 A * 12/1929 Judell ..... F16K 11/085 137/625.47
4,628,962 A * 12/1986 Pezzarossi ..... F16K 11/085 137/597
2008/0277611 A1* 11/2008 Esche ..... E03C 1/0404 251/149.1
2010/0043898 A1* 2/2010 Eckhaus ..... E03C 1/04 137/625

* cited by examiner

*Primary Examiner* — Janie M Loeppke
(74) *Attorney, Agent, or Firm* — Inspired Idea Solutions Law Firm

(57) ABSTRACT

A method and apparatus is disclosed for a combined base and add-on faucet. The faucet apparatus includes two inlet risers with valves and a bridge, or mixing chamber, extending therebetween. A first outlet riser intersects the bridge and caries mixed fluid to opposing ends. The first end may be capped, or may contain a third valve to control fluid output to a first nozzle to direct fluid downward. The second end may pass fluid through a vertical riser to an auxiliary faucet, such as a pre-rinse faucet, having a second nozzle.

20 Claims, 18 Drawing Sheets

SPOUTED BASE FAUCET

FIELD

The present disclosure generally relates to faucets or mixing valves, and more particularly to a double handled faucet.

BACKGROUND

The faucet is probably the most important fixture of any plumbing system as it allows delivery and control of water for various uses. Faucets, in their most basic form, were used by the Minoans, the Greeks, and the Romans, and have evolved much over time.

While early piping systems were a luxury known only to the highest class, their use has grown and become common place among the populations of every developed nation of the world, whether for home use, business use, or otherwise. With technological advancement has come development of various types of faucets.

Faucets may be classified as double-handled or single-handled, or may be grouped in other ways. While single-handled faucets may be common in many residential and commercial settings (e.g., bathrooms) double-handled faucets may be common in many commercial and perhaps even in some residential settings (e.g., kitchens). The faucet used in a particular setting may be selected to optimize performance in that setting.

In commercial kitchens, and perhaps elsewhere, a faucet apparatus may need to incorporate several faucets to achieve various functions in one working system. Thus a user may need to adjust water temperature, achieve maximum flow, achieve maximum water velocity, or other water performance characteristics. Historically, this has been achieved by stacking multiple types of faucets in series with each other, and using each separate faucet for a different functional purpose, which adds complexity and cost. Therefore, there is a need for an improved faucet apparatus with better flexibility in performance and simpler construction for installation and use.

SUMMARY

A faucet apparatus comprises a first inlet riser having a valve for controlling a first fluid from a first fluid source, a second inlet riser having a valve for controlling a second fluid from a second fluid source, a mixing chamber extending between the first inlet riser and the second inlet riser for fluid communication, the mixing chamber configured to mix the first fluid and the second fluid; and a first outlet riser intersecting the mixing chamber for fluid communication, the first outlet riser having a first end and a second end opposing the first end, the first outlet riser having at least one outlet port at the first end and at least one outlet port at the second end, wherein the first outlet riser is configured to allow mixed fluid to pass through the at least one outlet port at the first end, and wherein the first outlet riser is configured to allow mixed fluid to pass through the at least one outlet port at the second end.

A faucet apparatus comprises a first inlet riser having a valve for controlling a first fluid from a first fluid source, a second inlet riser having a valve for controlling a second fluid from a second fluid source, a mixing chamber extending between the first inlet riser and the second inlet riser for fluid communication, the mixing chamber configured to mix the first fluid and the second fluid, a first outlet riser intersecting the mixing chamber for fluid communication, the first outlet riser having a first end and a second end opposing the first end, the first outlet riser having a valve at the first end for controlling mixed fluid passing through a first outlet port at the first end, and a second outlet riser intersecting the second end of the first outlet riser for fluid communication, and wherein the second outlet riser is configured to carry mixed fluid to a second outlet port.

A method of controlling fluid passing through a faucet apparatus having a first inlet riser and a second inlet riser, a valve in the first and second inlet risers, respectively, a mixing chamber extending between the first inlet riser and the second inlet riser, and a first outlet riser intersecting the mixing chamber, the method comprises providing first and second fluids from first and second fluid sources to the first and second inlet risers, respectively, controlling a flow rate of the first and second fluids passing through the first and second inlet risers into the mixing chamber, mixing the first and second fluids in the mixing chamber to create mixed fluid, passing mixed fluid through a port at a first end of the first outlet riser, and passing mixed fluid through a port at a second end of the first outlet riser.

BRIEF DESCRIPTION OF THE DRAWINGS

Various aspects and advantages will become apparent upon review of the following detailed description and upon reference to the drawings in which.

DETAILED DESCRIPTION

The following disclosure includes a faucet apparatus and a method of configuring the faucet apparatus. The disclosure further includes a capped faucet apparatus. The faucet apparatus may be constructed as exemplified, yet the present disclosure contemplates various alternatives which may be structurally different, but which adhere to the spirit and scope of the present disclosure.

Figure 1:
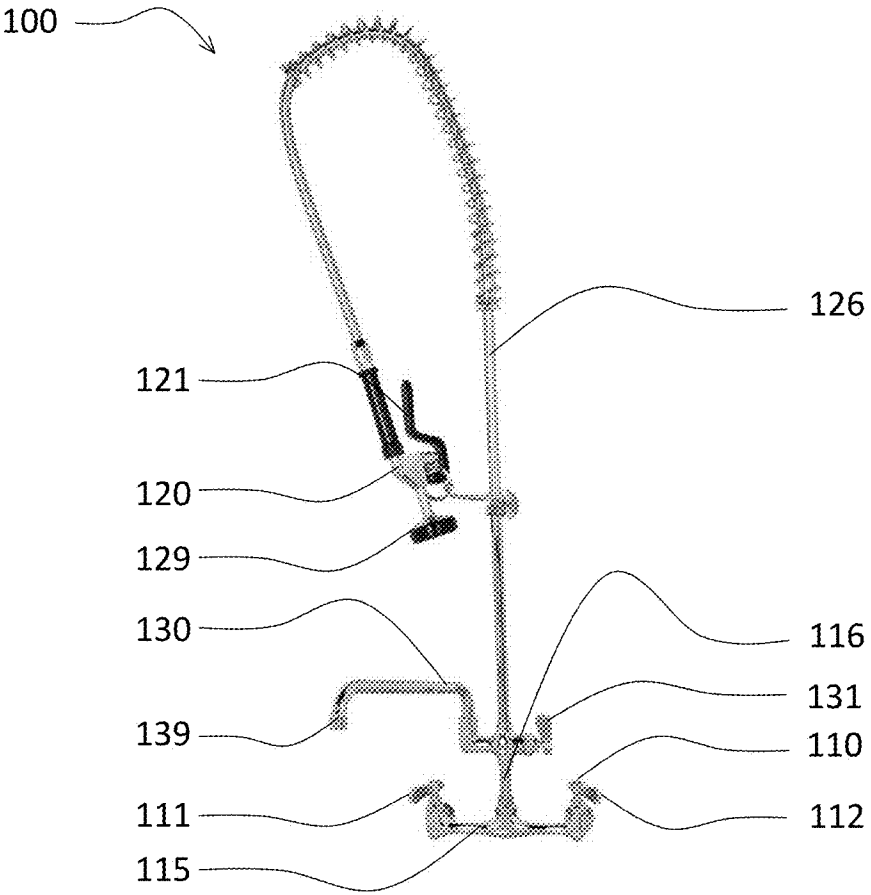
FIG. 1 PRIOR ART
FIG. 1 illustrates an isometric view of a prior art faucet apparatus.
Figure 2:
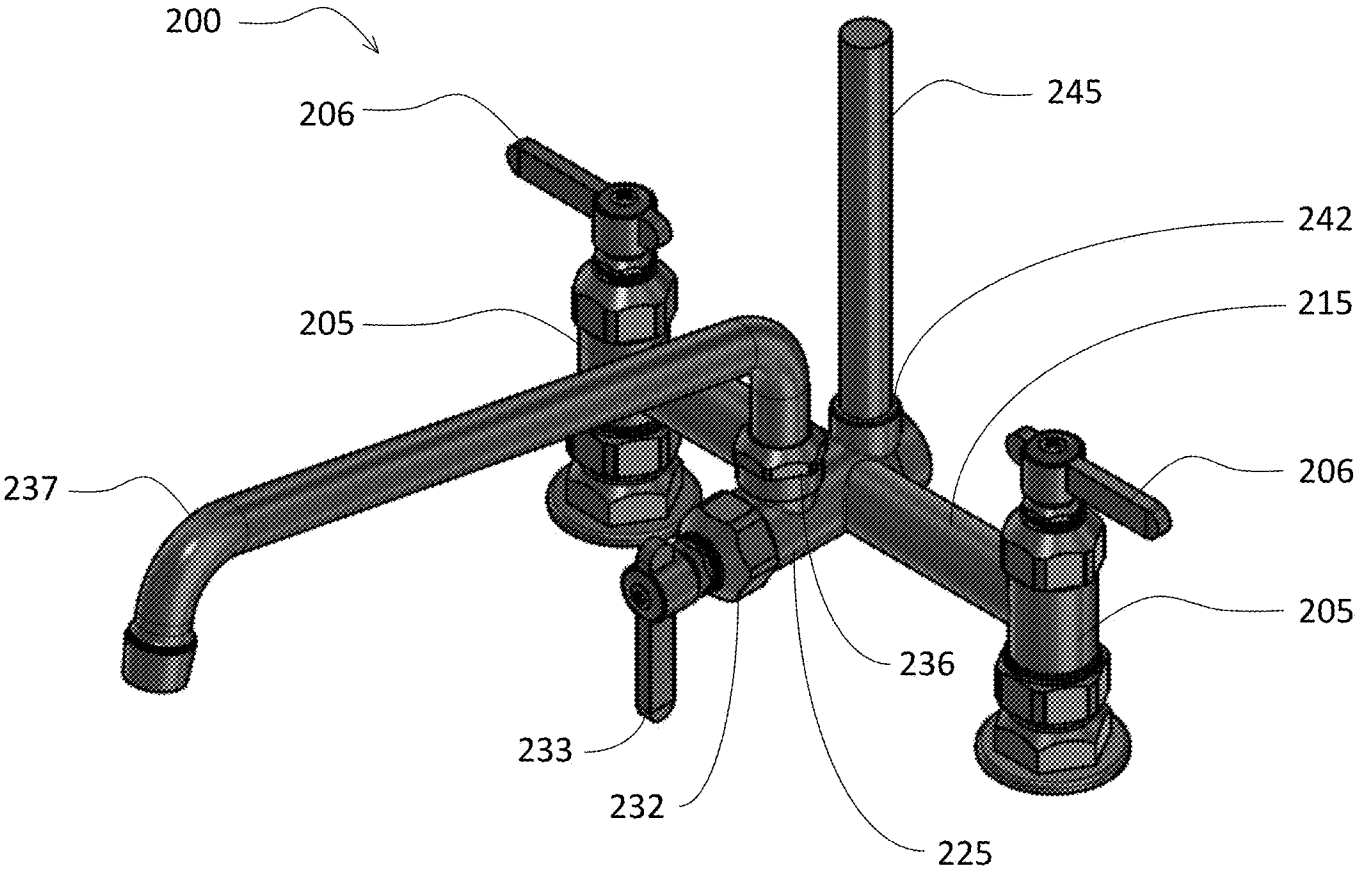
FIG. 2 illustrates an isometric view of a faucet apparatus.
Figure 3:
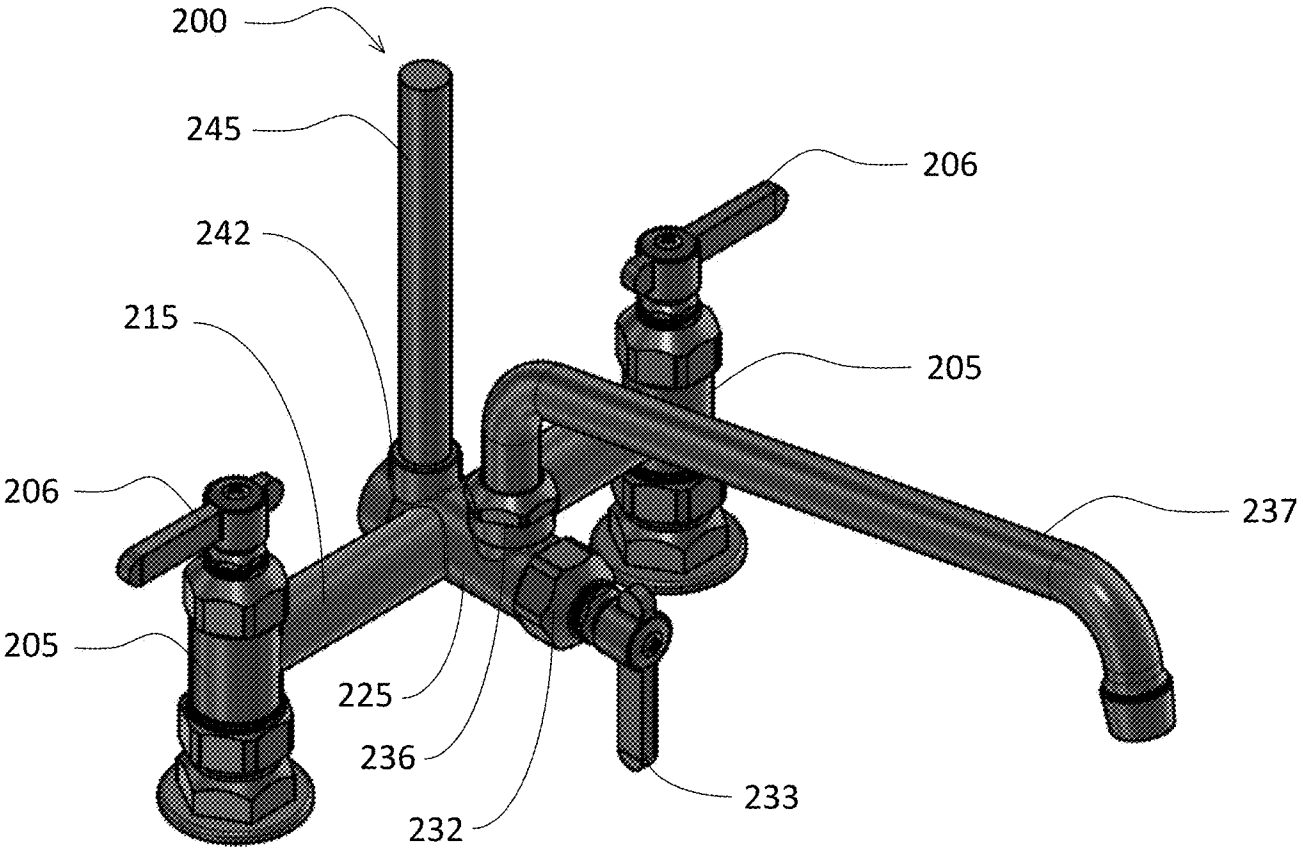
FIG. 3 illustrates an isometric view of the faucet apparatus of FIG. 2.
Figure 4:
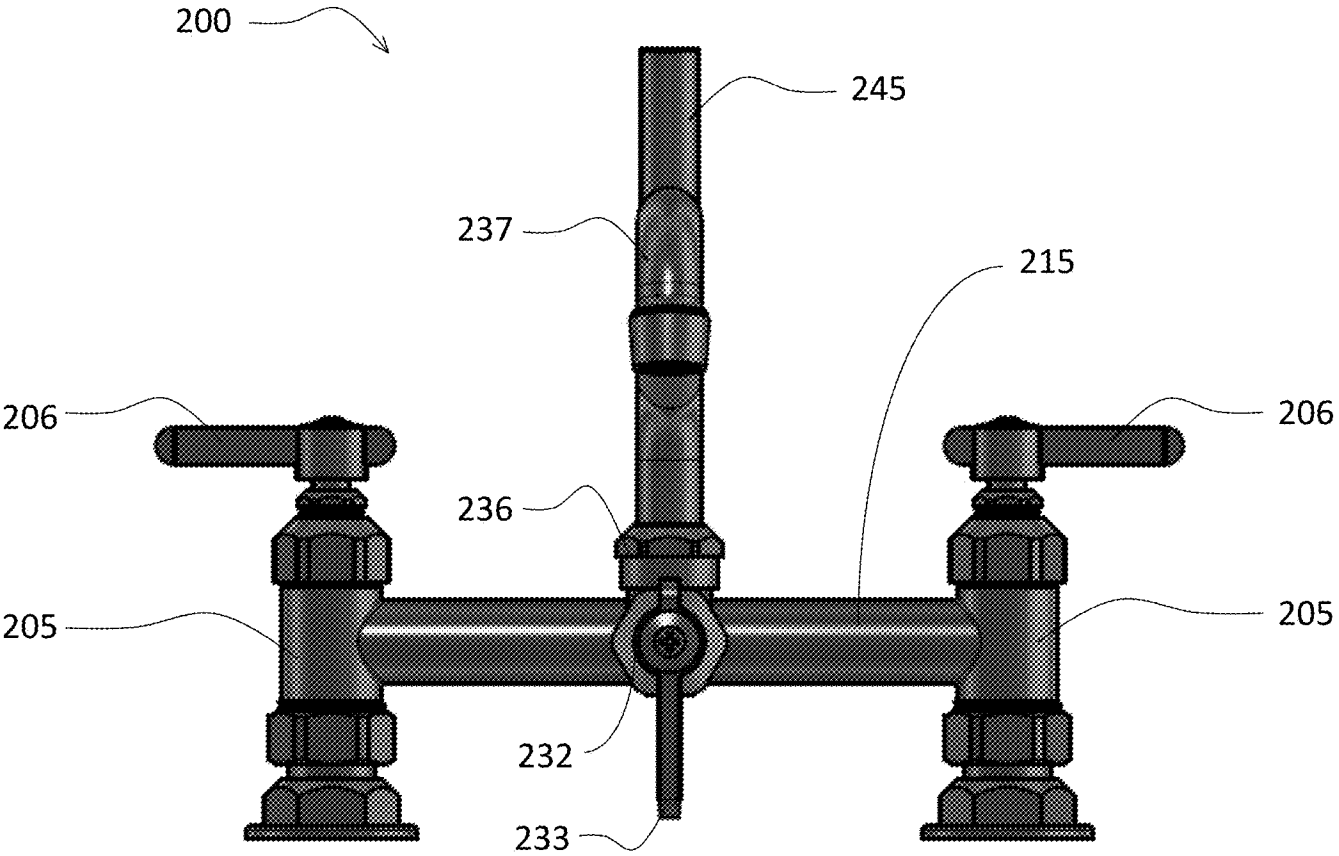
FIG. 4 illustrates a front side view of the faucet apparatus of FIG. 2.
Figure 5:
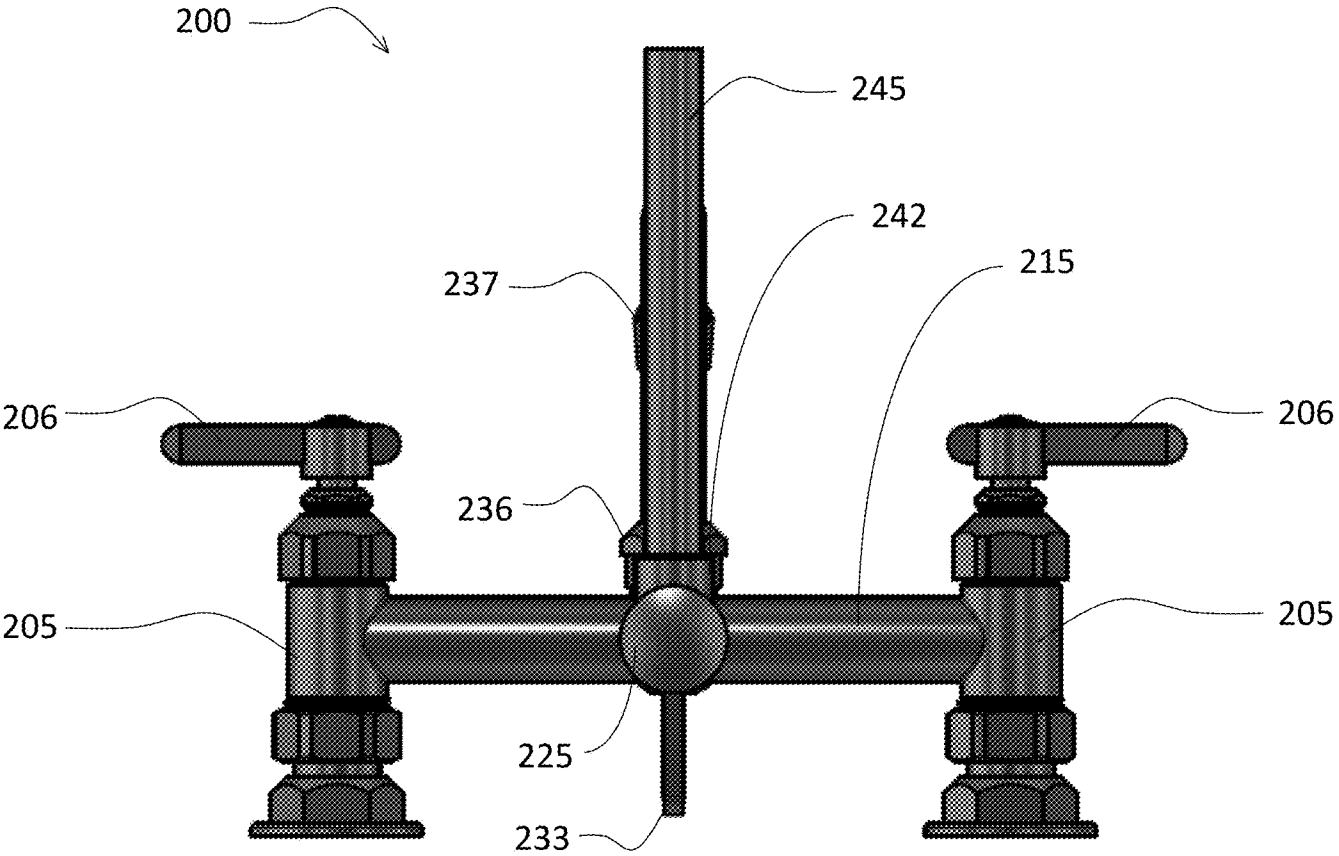
FIG. 5 illustrates a back side view of the faucet apparatus of FIG. 2.
Figure 6:
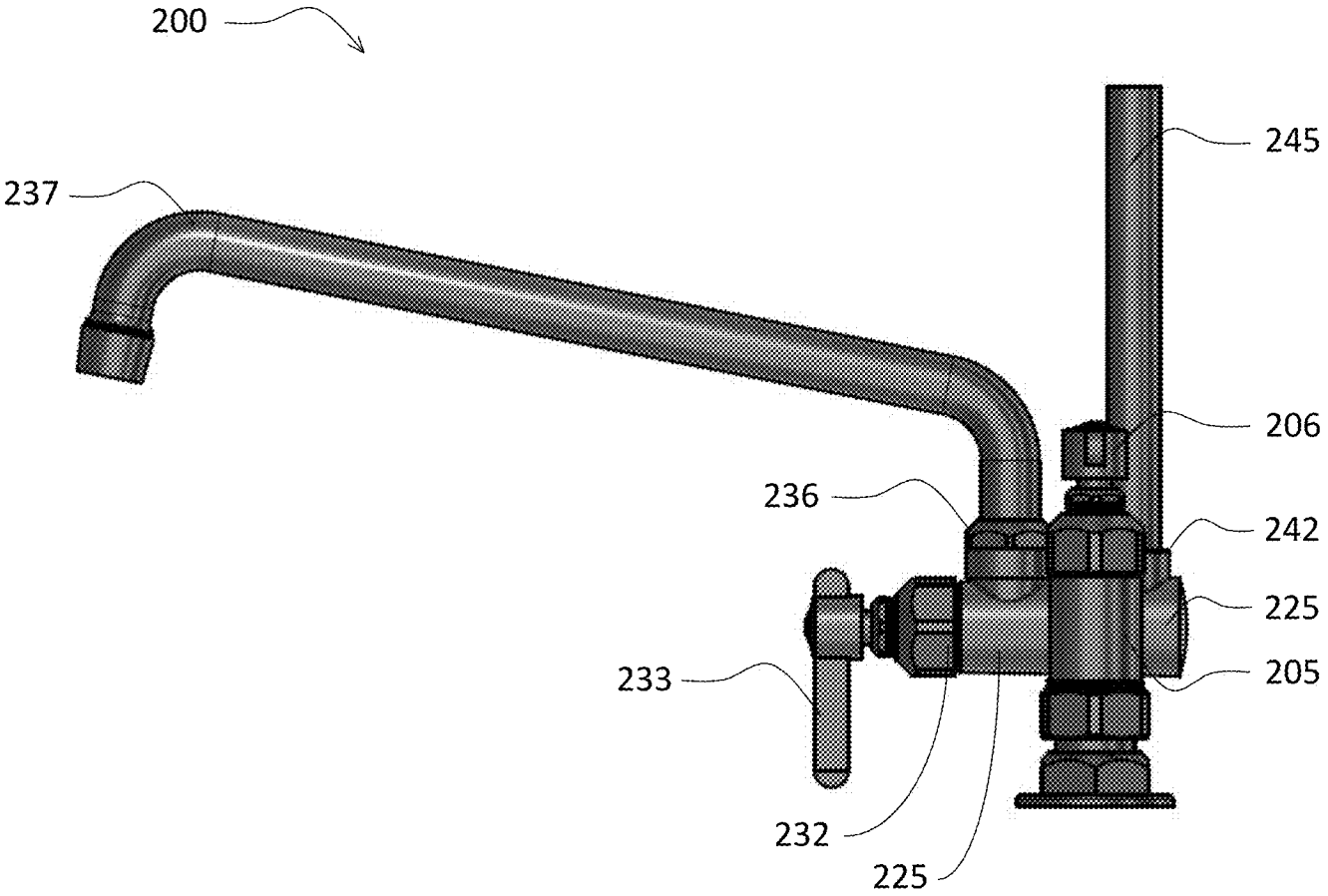
FIG. 6 illustrates a right side view of the faucet apparatus of FIG. 2.
Figure 7:
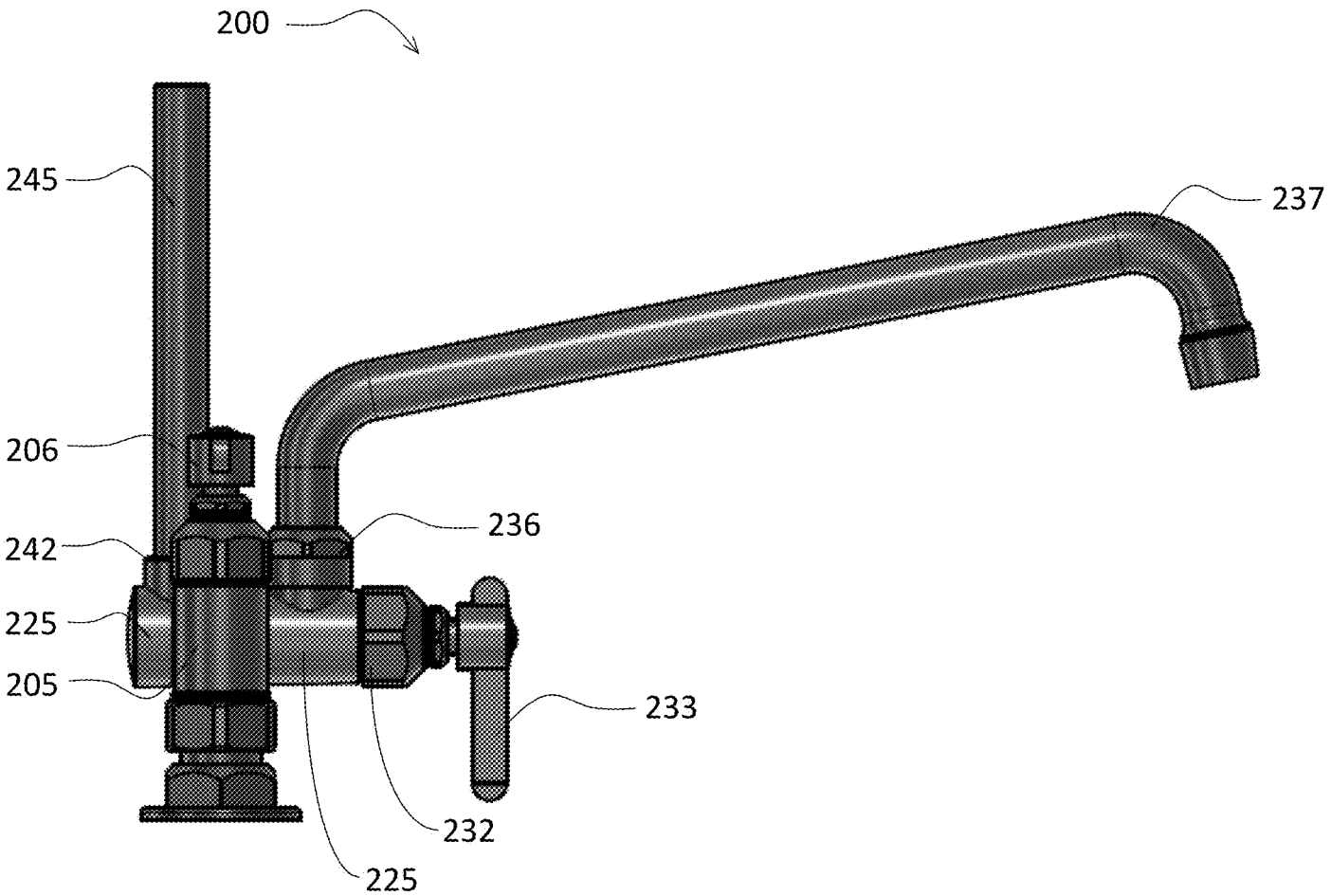
FIG. 7 illustrates a left side view of the faucet apparatus of FIG. 2.
Figure 8:
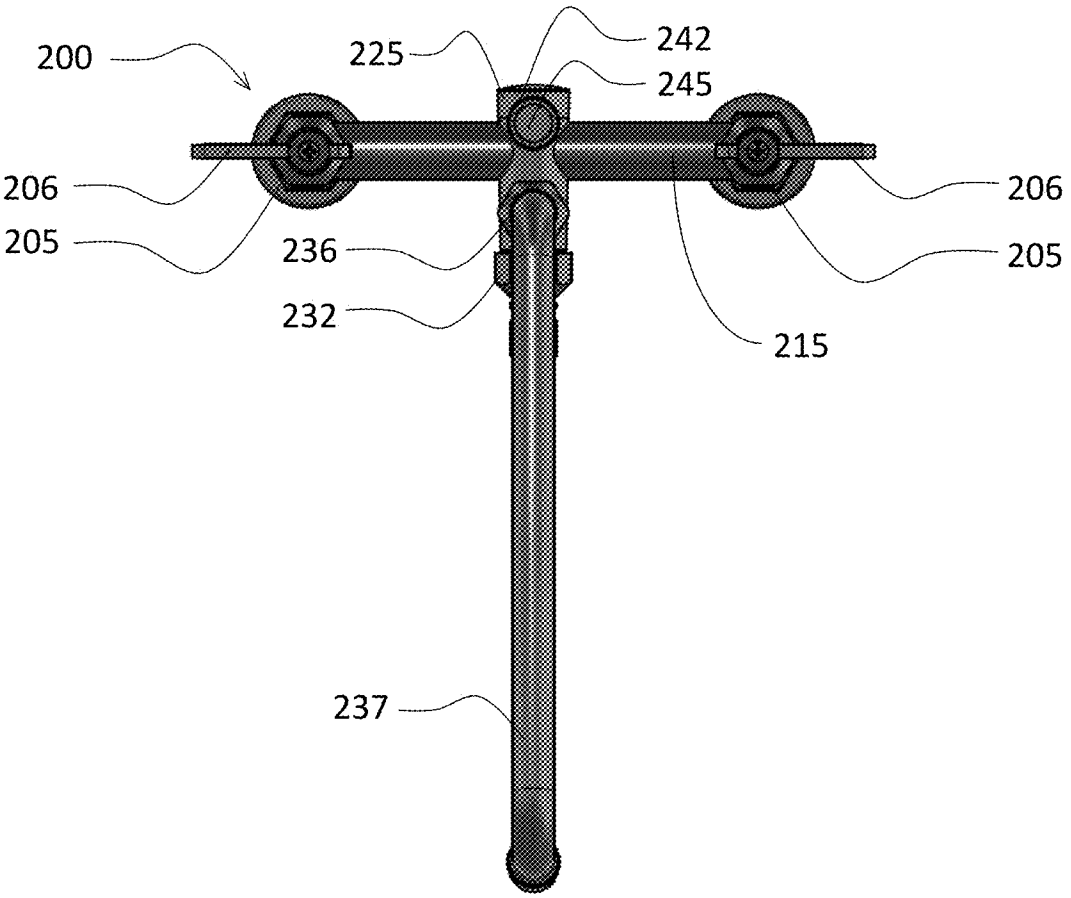
FIG. 8 illustrates a top side view of the faucet apparatus of FIG. 2.
Figure 9:
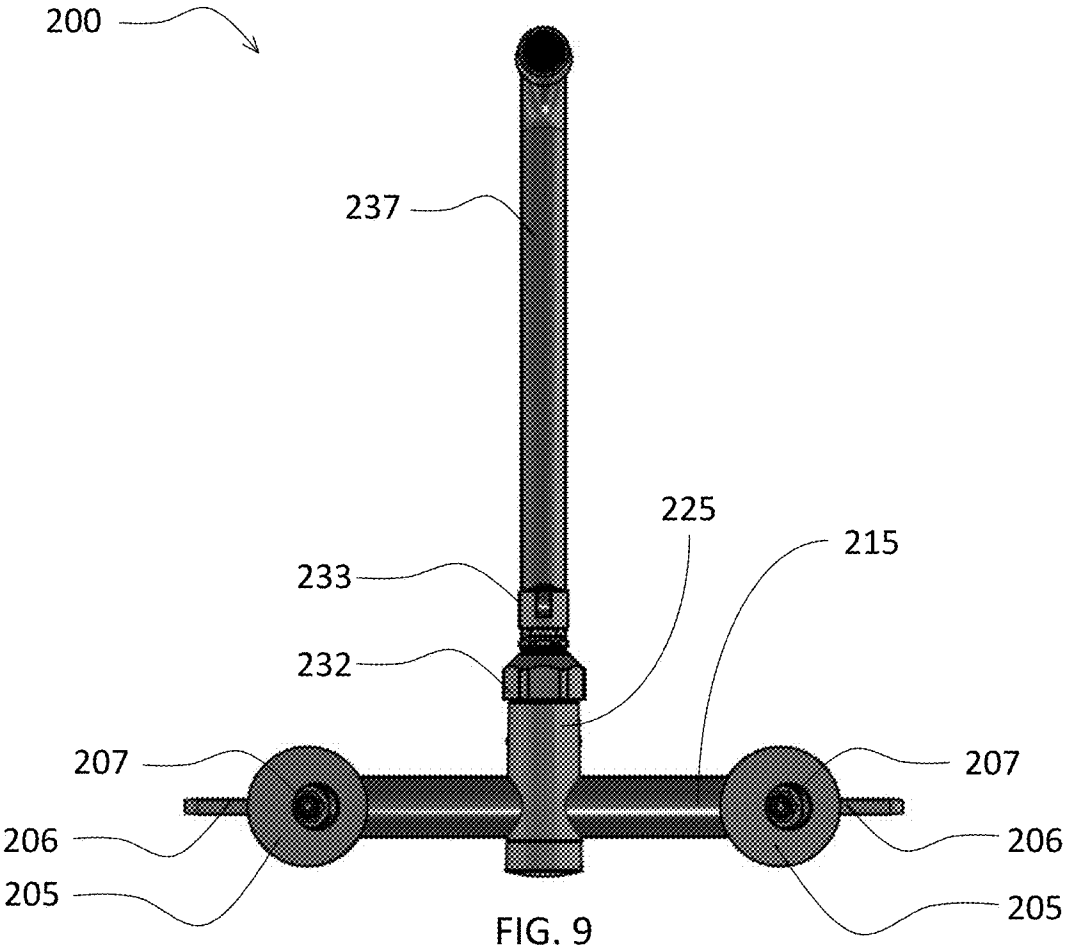
FIG. 9 illustrates a bottom side view of the faucet apparatus of FIG. 2.
Figure 10:
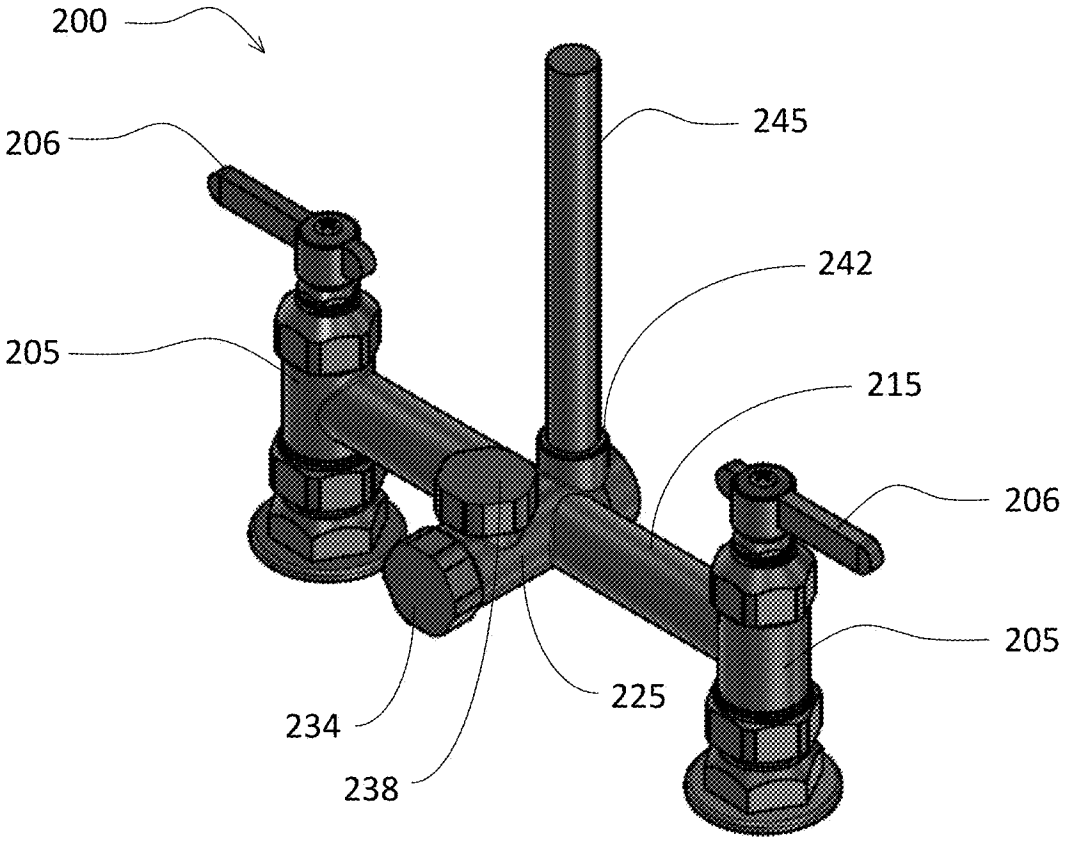
FIG. 10 illustrates an isometric view of a second faucet apparatus.
Figure 11:
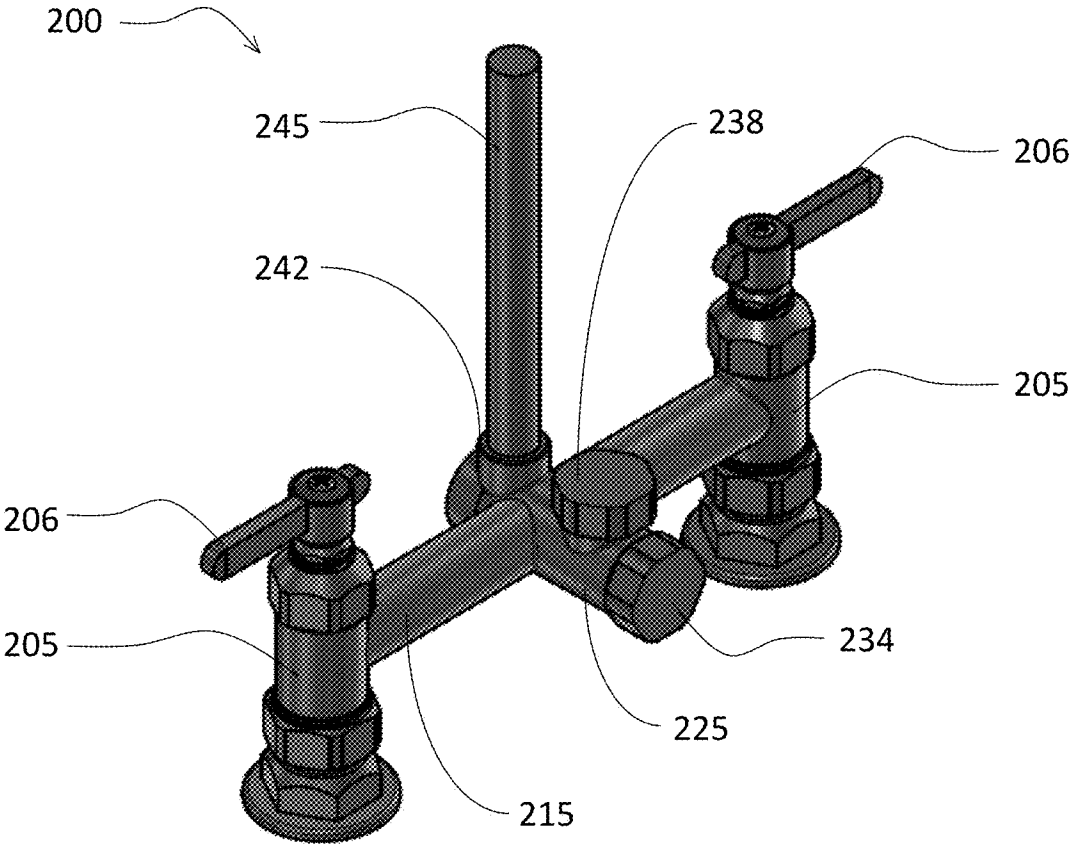
FIG. 11 illustrates an isometric view of the faucet apparatus of FIG. 10.
Figure 12:
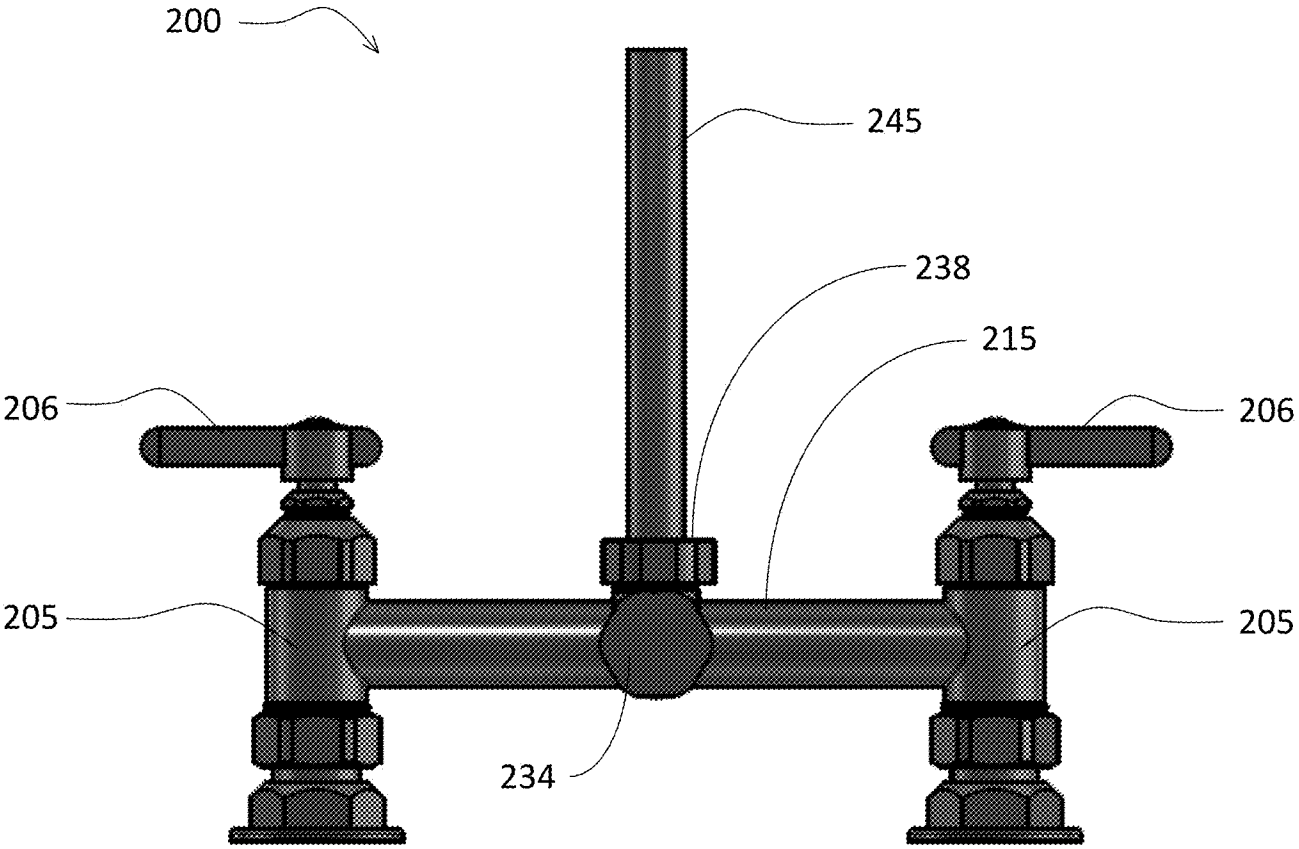
FIG. 12 illustrates a front side view of the faucet apparatus of FIG. 10.
Figure 13:
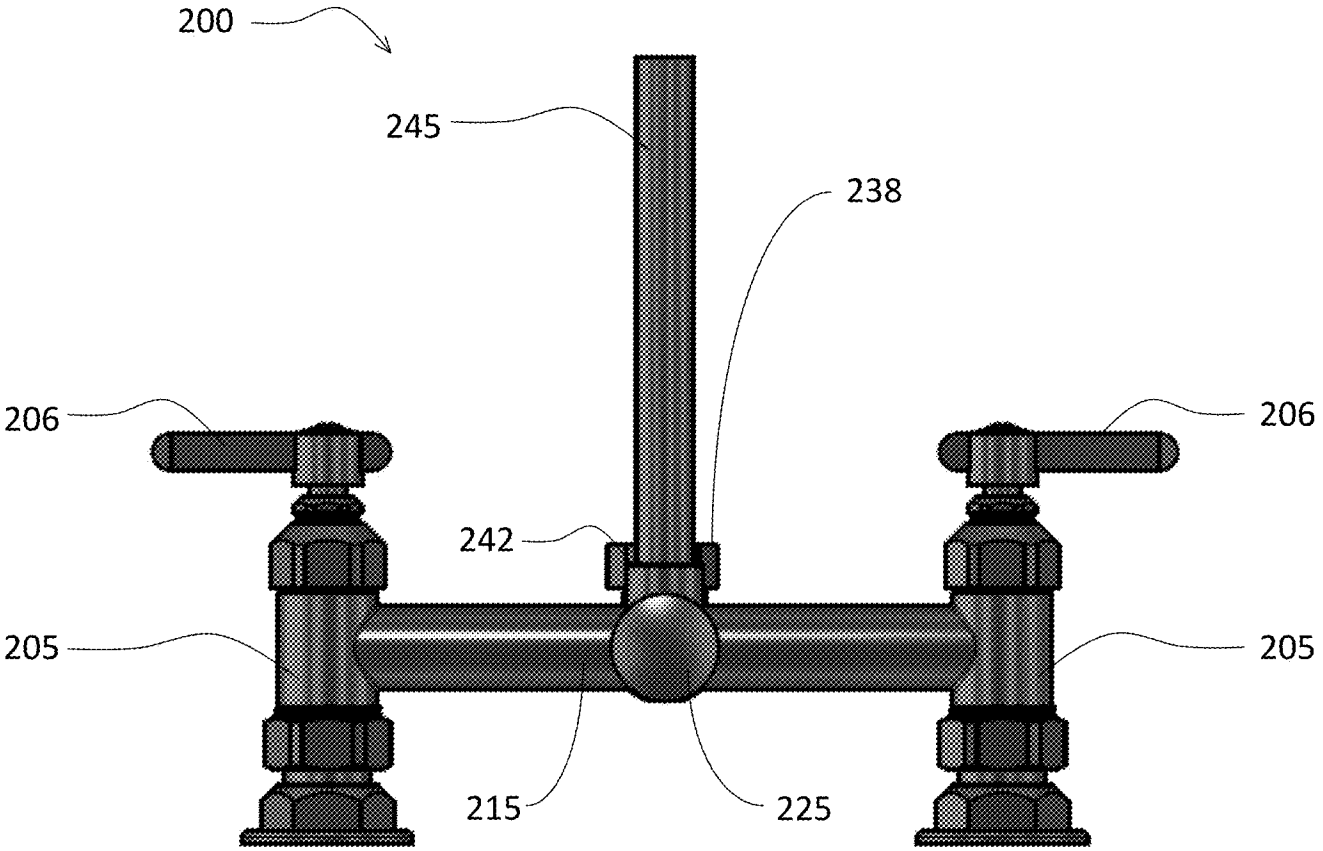
FIG. 13 illustrates a back side view of the faucet apparatus of FIG. 10.
Figure 14:
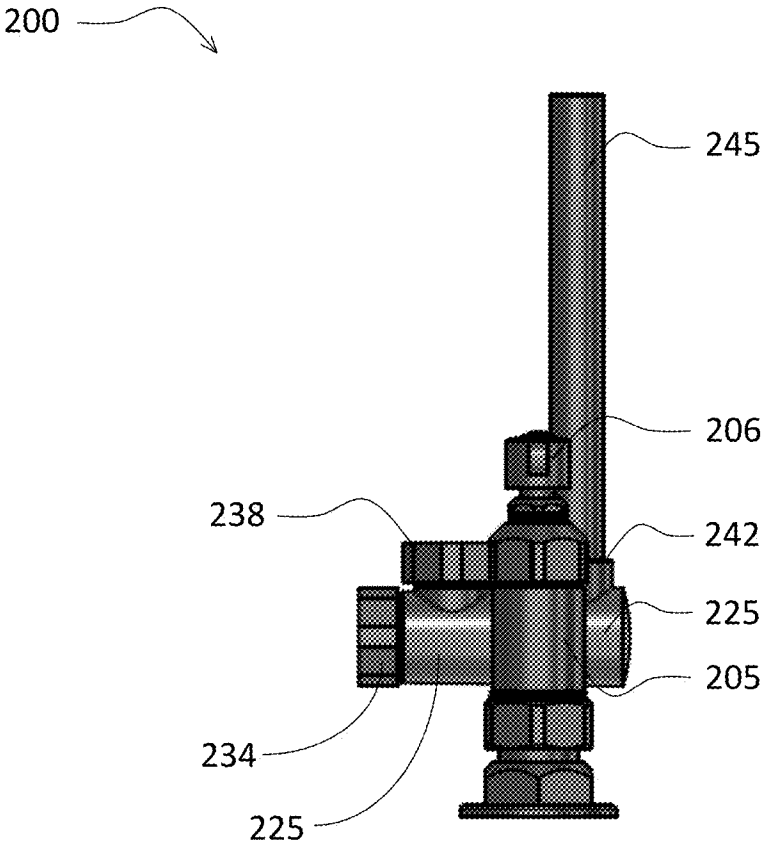
FIG. 14 illustrates a right side view of the faucet apparatus of FIG. 10.
Figure 15:
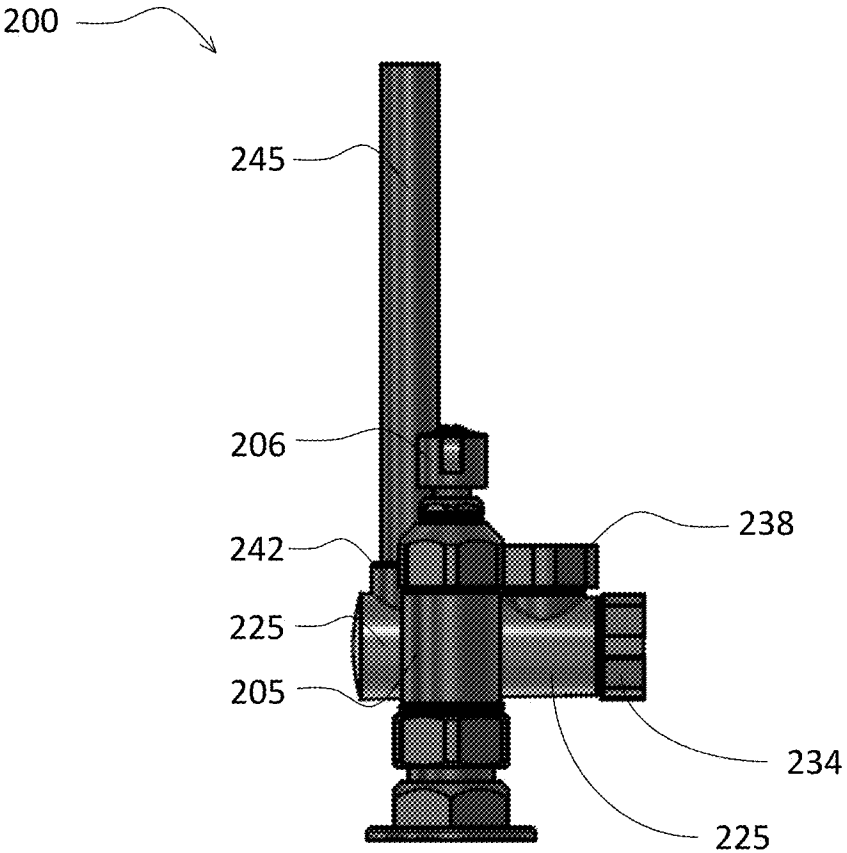
FIG. 15 illustrates a left side view of the faucet apparatus of FIG. 10.
Figure 16:
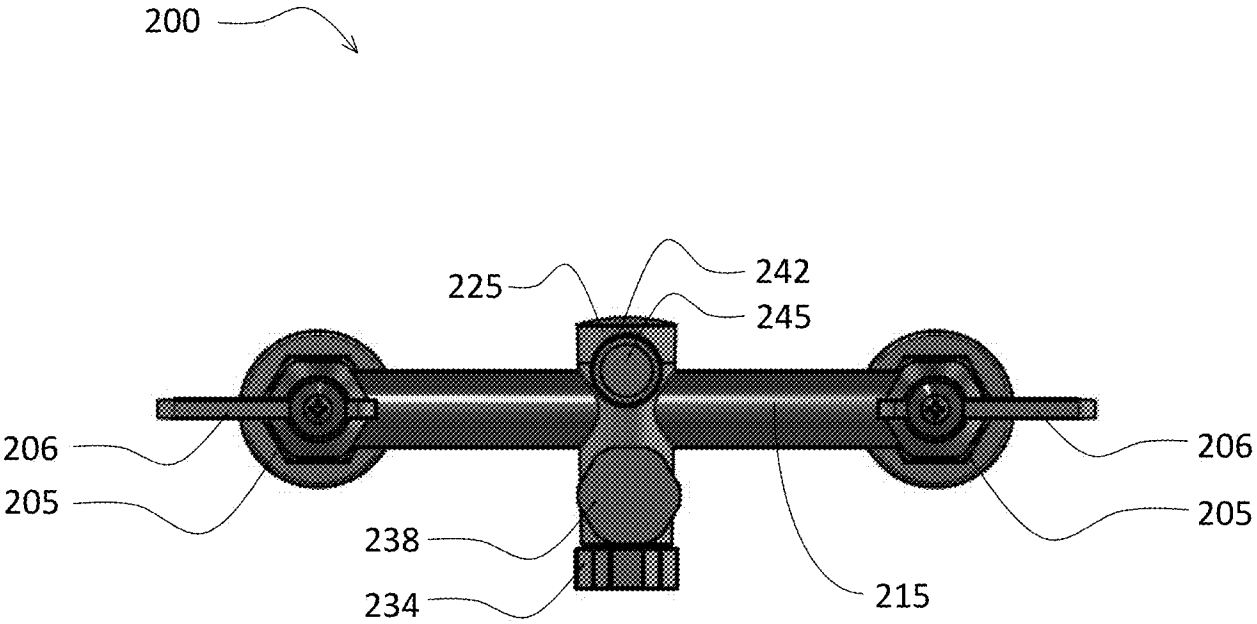
FIG. 16 illustrates a top side view of the faucet apparatus of FIG. 10.
Figure 17:
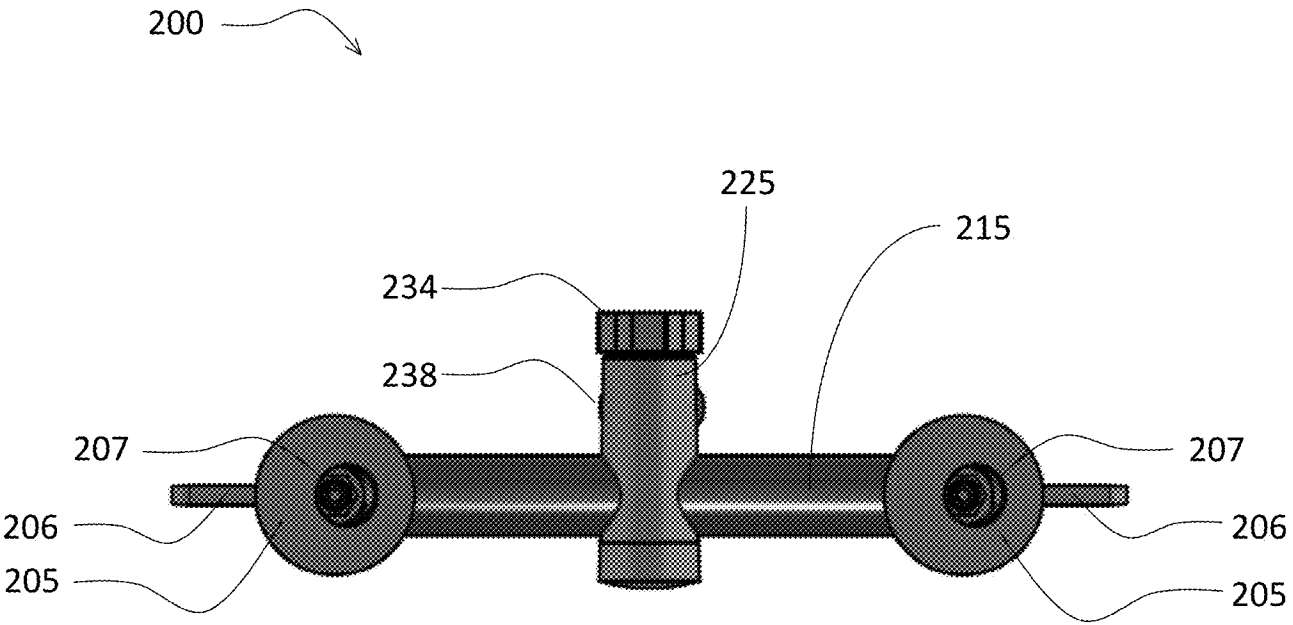
FIG. 17 illustrates a bottom side view of the faucet apparatus of FIG. 10.

FIG. 1 illustrates a prior art faucet apparatus 100. In general, faucet apparatus 100 is exemplified as including a base faucet 110, a pre-rinse faucet 120, and an add-on faucet 130. The base faucet 110 may be configured with two ports (extending rearwardly into the page) for receiving water and two valves for controlling water (the valves interconnected to, and operable by means of, handles 111, 112), the pairs of ports and valves disposed oppositely of a bridge 115 which may be in fluid communication with the two ports. A riser 116 may extend upward from, and may be in fluid communication with, bridge 115. The add-on faucet 130 may extend from, and may be in fluid communication with, riser 116. A riser 126 may extend upward from, and may be in fluid communication with, add-on faucet 130.

The pre-rinse faucet 120 may extend from, and be in fluid communication with, riser 126. Water may be received into pre-rinse faucet 120 through a single port and may be controlled by a single valve (the valve interconnected to, and operable by means of, handle 121). Water may be expelled through nozzle 129. Water may pass through add-on faucet 130, such as from riser 116 to riser 126. Further, water may be received into add-on faucet 130 to be controlled by a single valve (the valve interconnected to, and operable by means of, handle 131), and may be expelled through nozzle 139.

The illustration of FIG. 1 is representative of the complexity of faucets known in the prior art. The configuration of FIG. 1 has many limitations, in that it requires more parts, more parts means added costs, and more parts means longer assembly times to fit the base faucet 110, the add-on faucet 130, and the pre-rinse faucet 120 together (e.g., stacking configuration). Further, the combined assembly can become exceedingly high due to the stacking configuration, and versatility may be limited depending on space requirements where the faucet apparatus 100 is to be installed.

The addition of the add-on faucet 130 creates additional complexities in assembly, in that nozzle 139 (e.g., a swinging nozzle) may have a limited range of motion, or its motion may be restricted by riser 126. Therefore, there is a need for an improved faucet apparatus with better flexibility in performance and simpler construction for installation and use.

FIGS. 2-9 illustrate a faucet apparatus 200 of the present disclosure. Faucet apparatus 200 may overcome many, if not all, of the limitations of the prior art by combining the base faucet 110 and add-on faucet 130 of FIG. 1 into a unitary assembly. Faucet apparatus 200 may include one or more risers 205 having an open interior allowing for the passage of fluid (e.g., water). One or more ports 207 in the one or more risers 205 may enable fluid from a fluid source to pass into the one or more risers 205 (e.g., piping from a fluid source may interconnect with the one or more ports 207). The fluid source may be a positive fluid source (e.g., exhibiting fluid pressure causing fluid to move from the source into the one or more risers 205).

Each of the one or more risers 205 may contain a valve configured to regulate the passage of fluid through the one or more risers 205. Each valve may be articulated between open and shut positions, or anywhere therebetween, by one or more handles 206 coupled to each valve, respectively. The one or more risers 205 are exemplified as having a substantially circular cross-section, though other shapes are contemplated by this disclosure (e.g., polygonal cross-section, prism, and so forth).

The one or more risers 205 are exemplified with the one or more ports 207 on the bottom, though other configurations are contemplated by this disclosure (e.g., rearward ports, lateral ports, and so forth). Further, the one or more handles 206 are exemplified at the top of the one or more risers 205 for rotation about an axis extending vertically through the one or more risers 205, though the one or more handles 206 may be configured at other positions with respect to the one or more risers 205 and/or for rotation with respect to an axis extending other than vertically through the one or more risers 205 (e.g., a handle on a side of each riser and configured to rotate about an axis extending through bridge 215).

A bridge 215, or mixing chamber, having an open interior may extend between the one or more risers 205 (e.g., from a first riser 205 to a second riser 205). The open interior of bridge 215 may interconnect with the open interiors of the one or more risers 205, such that fluid may pass from the one or more risers 205 into bridge 215. While bridge 215 is exemplified as having a substantially circular cross-section, other shapes are contemplated by this disclosure (e.g., elliptical cross-section).

Bridge 215 may serve as a mixing chamber for fluid passing from each of the one or more risers 205 (e.g., hot and cold water may mix inside bridge 215). While two risers 205 are exemplified as interconnected by bridge 215, this disclosure contemplates greater or fewer of the one or more risers 205. The fluid to be mixed in bridge 215 may be water (e.g., at two or more temperatures), may be some other fluid, or some combination thereof.

A riser 225 having an open interior may extend between the one or more risers 205 and may intersect with bridge 215 (e.g., extending horizontally, orthogonally with respect to a longitudinal length of bridge 215, and/or orthogonally with respect to a longitudinal length of the one or more risers 205). Riser 225 may have opposing ends (e.g., a first end and a second end opposing the first end). Opposing ends of riser 225 may extend beyond bridge 215 (e.g., the first end extending on one side of bridge 215, and the second end extending on an opposing side of bridge 215). The open interior of riser 225 may interconnect with the open interior of bridge 215, such that fluid may pass from bridge 215 into riser 225. While riser 225 is exemplified as having a substantially circular cross-section, other shapes are contemplated by this disclosure (e.g., square cross-section).

In addition to any ports which enable the fluid interconnection between riser 225 and bridge 215, riser 225 may be configured with one or more additional ports (e.g., three additional ports). A first port 232 may be capped (e.g., as exemplified in FIGS. 10-17) or may be configured to receive a valve (e.g., extending into the open interior of riser 225). The valve may be articulated between open and shut positions, or anywhere therebetween, by a handle 233 coupled to the valve. The valve may regulate fluid flow to a second port 236. Second port 236 may be capped (e.g., as exemplified in FIGS. 10-17) or may be configured with a nozzle 237 to direct fluid flow passing through second port 236.

While nozzle 237 is exemplified having a substantially circular cross-section, other shapes are contemplated by the present disclosure (e.g., crescent cross-section). Further, while nozzle 237 is exemplified having approximately an up-side-down "U" shape, a "n" shape, an "n" shape, and/or a sideways "C" shape, other shapes are contemplated by this disclosure. Where riser 225 is other than horizontally configured, nozzle 237 may be configured to direct fluid passing therethrough into approximately (e.g., within thirty degrees of) a downward direction (e.g., into a sink, pot, tub, or other basin). Nozzle 237 may be fixed with respect to riser 225, or may be configured for rotation (e.g., rotatable at second port 236, about a vertical axis, and/or about an axis orthogonal to the longitudinal length of riser 225). Further, nozzle 237 may be shaped so that during rotation nozzle 237 does not collide with bridge 215, risers 205, handles 206 and/or handle 233.

A third port 242 may be capped or may be configured to interconnect with a riser 245 having an open interior (e.g., extending vertically, orthogonally with respect to a longitudinal length of riser 225, orthogonally with respect to a longitudinal length of bridge 215, and/or parallel with respect to a longitudinal length of the one or more risers 205). The open interior of riser 225 may interconnect with the open interior of riser 245 at third port 242, such that fluid may pass from riser 225 into riser 245. Riser 245 may carry fluid to another nozzle or faucet assembly coupled to faucet apparatus 200, such as a pre-rinse faucet (e.g., roughly equivalent to pre-rinse faucet 120 of FIG. 1). While not discussed in tremendous detail, the various component parts described above may be joined at each port in a manner known in the art, such as by weld, using male and female threaded fastening means, and so forth.

The improvements detailed in this disclosure both simplifies construction and installation by combining elements of a base faucet and an add-on faucet into a single apparatus, thus reducing the number of parts, reducing installation time and/or reducing cost. The combined assembly presented in FIGS. 2-9 may also enable any additional nozzle or faucet assembly attached to riser 245 to be positioned lower, reducing the overall height of the faucet apparatus 200. The elimination of the need for an add-on faucet also reduces the possibility of riser 245 becoming an obstruction against movement of nozzle 237.

FIGS. 10-17 illustrate the faucet apparatus 200 with slight modification. Outlet ports (e.g., port 232, 236) may be capped. The first port 232 may be capped (e.g., by cap 234) or may be configured to receive a valve (e.g., as exemplified in FIGS. 2-9). The second port 236 may be capped (e.g., by cap 238) or may be configured with a nozzle (e.g., as exemplified in FIGS. 10-17). Thus, in this configuration, faucet apparatus 200 may be used as a mixing chamber for fluids being passed solely through the open interior of riser 245 (e.g., to supply fluid to an auxiliary faucet coupled to faucet apparatus 200 via riser 245).

Figure 18:
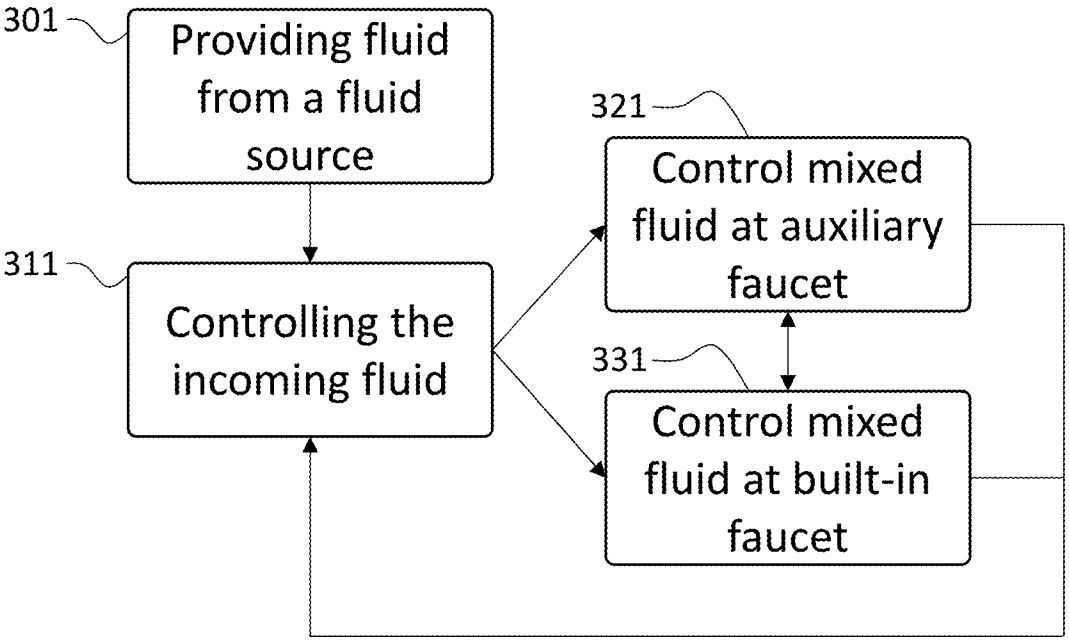
FIG. 18 illustrates a block diagram of a method.

FIG. 18 illustrates a block diagram of a method of operating a faucet apparatus. In a method of operating a faucet apparatus (e.g., faucet apparatus 200 of FIGS. 2-9), fluid may be provided from a fluid source at 301. Where the faucet apparatus is configured for multiple fluids (e.g., hot and cold water), the fluid source may be two fluid sources, or the fluid source may be split with a fluid treatment being applied to at least one branch split from the fluid source (e.g., heating water). Each fluid and/or treated fluid may be passed to a discrete inlet riser (e.g., the one or more risers 205) of the faucet apparatus (e.g., an inlet riser for each fluid source and/or for each branch split from the fluid source).

Fluid from the fluid source (e.g., incoming fluid) may be controlled at each inlet riser at 311. Each inlet riser may be equipped with a valve configured to regulate the passage of fluid through the inlet riser. A handle may be coupled to each valve to enable articulation between open and shut positions, or anywhere therebetween. Fluid may pass through the inlet risers into a mixing chamber (e.g., bridge 215), and may be mixed therein. Thus, the mixed fluid may be able to take on a range of characteristics based on the flow rate of fluid passing through each discrete inlet riser (e.g., selecting a desired temperature of mixed water by controlling the flow rate of hot and cold water).

Mixed fluid may be controlled at an outlet nozzle corresponding to an auxiliary faucet at 321 (e.g., a pre-rinse faucet). A corresponding valve of the auxiliary faucet may be articulated between open and shut positions, or anywhere therebetween (e.g., a trigger valve, or valve actuated by a trigger and/or squeezable handle). Upon actuation of the valve, mixed fluid may pass from the mixing chamber (e.g., bridge 215) through one or more outlet risers (e.g., riser 225 and/or riser 245) to the auxiliary faucet. Further, the mixed fluid may pass through the auxiliary faucet (e.g., through the open valve) to the outlet nozzle to be dispensed as desired by the user of the faucet apparatus. The outlet nozzle of the auxiliary faucet may enable exiting mixed fluid to be directed downwardly or in any desired direction. The auxiliary faucet may be equipped with a flexible portion enabling outlet nozzle to be moved in any direction and/or to any orientation.

Mixed fluid may be controlled at an outlet nozzle corresponding to a built-in faucet at 331 (e.g., riser 225, nozzle 237, and a corresponding valve coupled to handle 233). A corresponding valve of the built-in faucet may be articulated between open and shut positions, or anywhere therebetween (e.g., via handle 233). Upon actuation of the valve, mixed fluid may pass from the mixing chamber (e.g., bridge 215) through at least one outlet riser (e.g., riser 225) to the outlet nozzle of the built-in faucet (e.g., nozzle 237). The outlet nozzle of the built-in faucet may enable exiting mixed fluid to be directed downwardly (e.g., within thirty degrees of a vertical direction) or in any desired direction (e.g., having a flexible portion, a pull-out feature, one or more rotatable segments, or other feature known in the art).

Steps 321 and 331 may be performed in any order and/or simultaneously. Further, step 311 may be performed before either or both of steps 321 and 331, after either or both of steps 321 and 331, or both (e.g., adjusting fluid composition while fluid is dispensed).

Other aspects will be apparent to those skilled in the art from consideration of the specification and practice disclosed herein. It is intended, therefore, that the specification and illustrated figures be considered as examples only.

What is claimed is:

1. A faucet apparatus, comprising:

a first inlet riser having a valve for controlling a first fluid from a first fluid source;

a second inlet riser having a valve for controlling a second fluid from a second fluid source;

a mixing chamber extending between the first inlet riser and the second inlet riser for fluid communication, the mixing chamber configured to mix the first fluid and the second fluid; and a first outlet riser intersecting the mixing chamber for fluid communication, the first outlet riser having a first outlet port at a first end and a second outlet port at a second end, the second outlet port positioned oppositely of the mixing chamber with respect to the first outlet port, wherein the first outlet riser is configured to allow mixed fluid to pass through the first outlet port at the first end, and wherein the first outlet riser is configured to allow mixed fluid to pass through the second outlet port at the second end.

2. The faucet apparatus of claim 1, wherein a valve is positioned at the first end for controlling mixed fluid passing through the first outlet port.

3. The faucet apparatus of claim 1, wherein a second outlet riser intersects the second end of the first outlet riser at the second outlet port for fluid communication, and wherein the second outlet riser is configured to carry mixed fluid to a third outlet port.

4. The faucet apparatus of claim 3, wherein the second outlet riser intersects with an auxiliary faucet for fluid communication, and wherein the third outlet port is a nozzle of the auxiliary faucet.

5. The faucet apparatus of claim 1, wherein a longitudinal length of the mixing chamber extends approximately orthogonally to longitudinal lengths of the first inlet riser and the second inlet riser.

6. The faucet apparatus of claim 1, wherein a longitudinal length of the first outlet riser extends approximately orthogonally to a longitudinal length of the mixing chamber.

7. The faucet apparatus of claim 1, wherein a cap is coupled to the first outlet port at the first end to restrict fluid communication.

8. The faucet apparatus of claim 1, wherein a nozzle is coupled to the first outlet port at the first end for fluid communication, and wherein the nozzle is configured to direct fluid flow approximately downward.

9. A faucet apparatus, comprising:

a first inlet riser having a valve for controlling a first fluid from a first fluid source;

a second inlet riser having a valve for controlling a second fluid from a second fluid source;

a mixing chamber extending between the first inlet riser and the second inlet riser for fluid communication, the mixing chamber configured to mix the first fluid and the second fluid;

a first outlet riser intersecting the mixing chamber for fluid communication, the first outlet riser having a first outlet port at a first end and a second outlet port at a second end, the second outlet port positioned oppositely of the mixing chamber with respect to the first outlet port, the first outlet riser having a valve at the first end for controlling mixed fluid passing through the first outlet port at the first end; and a second outlet riser intersecting the second end of the first outlet riser at the second outlet port for fluid communication, and wherein the second outlet riser is configured to carry mixed fluid to a third outlet port.

10. The faucet apparatus of claim 9, wherein the second outlet riser intersects with an auxiliary faucet for fluid communication, and wherein the third outlet port is a nozzle of the auxiliary faucet.

11. The faucet apparatus of claim 9, wherein a longitudinal length of the second outlet riser extends approximately orthogonally to a longitudinal length of the first outlet riser.

12. The faucet apparatus of claim 9, wherein a longitudinal length of the second outlet riser extends approximately orthogonally to a longitudinal length of the mixing chamber.

13. The faucet apparatus of claim 9, wherein a longitudinal length of the second outlet riser extends approximately parallel to longitudinal lengths of the first inlet riser and the second inlet riser.

14. A method of controlling fluid passing through a faucet apparatus having a first inlet riser and a second inlet riser, a valve in each of the first and second inlet risers, respectively, a mixing chamber extending between the first inlet riser and the second inlet riser, and a first outlet riser intersecting the mixing chamber, the method comprising:

providing first and second fluids from first and second fluid sources to the first and second inlet risers, respectively;

controlling a flow rate of the first and second fluids passing through the first and second inlet risers into the mixing chamber;

mixing the first and second fluids in the mixing chamber to create mixed fluid;

passing mixed fluid through a first outlet port at a first end of the first outlet riser; and passing mixed fluid through a second outlet port at a second end of the first outlet riser, wherein the second outlet port is positioned oppositely of the mixing chamber with respect to the first outlet port.

15. The method of claim 14, wherein a valve is positioned at the first end of the first outlet riser, and wherein passing mixed fluid through the first outlet port at the first end is controlled by the valve.

16. The method of claim 14, wherein a second outlet riser intersects the second end of the first outlet riser at the second outlet port, and wherein mixed fluid is passed through the second outlet port at the second end into the second outlet riser.

17. The method of claim 16, wherein the second outlet riser intersects with an auxiliary faucet, and wherein mixed fluid is passed through the second outlet riser to the auxiliary faucet.

18. The method of claim 16, wherein a longitudinal length of the second outlet riser extends approximately orthogonally to a longitudinal length of the first outlet riser.

19. The method of claim 14, wherein a longitudinal length of the mixing chamber extends approximately orthogonally to longitudinal lengths of the first inlet riser and the second inlet riser.

20. The method of claim 14, wherein a longitudinal length of the first outlet riser extends approximately orthogonally to a longitudinal length of the mixing chamber.

* * * * *